US011530830B2

(12) United States Patent
Watanabe et al.

(10) Patent No.: US 11,530,830 B2
(45) Date of Patent: Dec. 20, 2022

(54) AIR-CONDITIONING APPARATUS

(71) Applicant: Mitsubishi Electric Corporation, Tokyo (JP)

(72) Inventors: Kazuki Watanabe, Tokyo (JP); Masahiko Takagi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/278,915

(22) PCT Filed: Nov. 20, 2018

(86) PCT No.: PCT/JP2018/042820
§ 371 (c)(1),
(2) Date: Mar. 23, 2021

(87) PCT Pub. No.: WO2020/105117
PCT Pub. Date: May 28, 2020

(65) Prior Publication Data

US 2022/0034534 A1 Feb. 3, 2022

(51) Int. Cl.
*F24F 11/36* (2018.01)
*F24F 11/526* (2018.01)
(Continued)

(52) U.S. Cl.
CPC ..... *F24F 11/36* (2018.01); *F24F 11/526* (2018.01); *F24F 11/56* (2018.01); *F25B 49/005* (2013.01);
(Continued)

(58) Field of Classification Search
CPC ..... F24F 11/56; F24F 11/36; F24F 11/526; F24F 2120/10; F24F 2130/00; F24F 2500/222
See application file for complete search history.

(56) References Cited

U.S. PATENT DOCUMENTS 11,125,457 B1 * 9/2021 Alfano ..... F24F 11/56
2016/0245566 A1 * 8/2016 Hiraki ..... F24F 11/77
(Continued)

FOREIGN PATENT DOCUMENTS

JP H08-087690 A 4/1996
JP 2001-094637 A 4/2001
(Continued)

OTHER PUBLICATIONS

Office Action dated Sep. 21, 2021, issued in corresponding JP Patent Application No. 2020-557065 (and English Machine Translation).
(Continued)

*Primary Examiner* — Nelson J Nieves
(74) *Attorney, Agent, or Firm* — Posz Law Group, PLC

(57) ABSTRACT

In an air-conditioning apparatus, an indoor unit and an outdoor unit are connected to each other by a refrigerant pipe through which refrigerant flows. The air-conditioning apparatus includes: a refrigerant detection unit that detects a leak of the refrigerant in the indoor unit; a notification unit that makes a notification indicating occurrence of the leak of the refrigerant; a controller that controls at least the notification unit; and a remote control unit configured to operate the indoor unit. When the refrigerant detection unit detects the leak of the refrigerant, the controller controls the notification unit to make in a first mode the notification indicating the occurrence of the leak of the refrigerant, and make the notification in a second mode different from the first mode after a predetermined time period elapses from time at which the notification in the first mode is made. Thus, since the notification of the refrigerant leak is made two steps, that is, in the first mode in a first step and in the second mode in a second step, it is possible to cause a user to pay more attention to the notifications, and thus cause the user to
(Continued)

easily notice the notification. It is therefore possible to cause the user to sufficiently know the refrigerant leak.

9 Claims, 6 Drawing Sheets

(51) Int. Cl.
*F24F 11/56* (2018.01)
*F25B 49/00* (2006.01)
*F24F 120/10* (2018.01)
*F24F 130/00* (2018.01)

(52) U.S. Cl.
CPC ..... *F24F 2120/10* (2018.01); *F24F 2130/00* (2018.01); *F25B 2500/222* (2013.01)

(56) References Cited

U.S. PATENT DOCUMENTS

2016/0334811 A1* 11/2016 Marten ..... G05D 23/1931
2019/0186769 A1* 6/2019 Zimmermann ..... F25B 49/005
2019/0331377 A1 10/2019 Matsuda et al.
2020/0049361 A1* 2/2020 Minamida ..... F25B 49/02
2020/0124306 A1* 4/2020 Kowald ..... F24F 11/526
2021/0285673 A1* 9/2021 Kadowaki ..... F24F 11/58

FOREIGN PATENT DOCUMENTS

JP 2007-077918 A 3/2007
JP 2015-094513 A 5/2015
JP 2016-114333 A 6/2016
JP 2016-223650 A 12/2016
JP 2018-091550 A 6/2018
JP 2018-155461 A 10/2018
JP 2018-173250 A 11/2018
WO 2018/134949 A1 7/2018

OTHER PUBLICATIONS

International Search Report of the International Searching Authority dated Jan. 15, 2019 for the corresponding International application No. PCT/JP2018/042820 (and English translation).

* cited by examiner

AIR-CONDITIONING APPARATUS

CROSS REFERENCE TO RELATED APPLICATION

This application is a U.S. national stage application of PCT/JP2018/042820 filed on Nov. 20, 2018, the contents of which are incorporated herein by reference.

TECHNICAL FIELD

The present disclosure relates to an air-conditioning apparatus provided with an indoor unit and an outdoor unit that are connected to each other by a refrigerant pipe through which refrigerant flows.

BACKGROUND ART

In recent years, in terms of measures against global warming, it has been required to use refrigerant having a low global warming potential as refrigerant for use in air-conditioning apparatuses. As such refrigerant, HFC32 having a lower global warming potential than HFC410A becomes mainstream.

However, HFC32 is slightly flammable. Also, many kinds of other refrigerants having a low global warming potential are flammable although they have different combustion characteristics. Furthermore, as the refrigerant having a low global warming potential, it is studied to use refrigerant having a lower environmental load, such as propane or $CO_2$ in the future, and it is necessary to pay more attention to safety.

Suppose the user does not notice a leak of flammable refrigerant even when a predetermined time period elapses from the time at which the leak of the flammable refrigerant occurs. In this case, there is a risk that a room in which an indoor unit from which the refrigerant leaks is installed will not be ventilated and the refrigerant will not be diffused, as a result of which in a given area, the concentration of the refrigerant will be increased to a high level by accumulation of the refrigerant. This is an emergency situation, and the user needs to be immediately notified of the leak of the refrigerant by some notification means, because the leaking refrigerant is flammable.

As existing notification means, in general, in order to make a notification, a lamp provided at a decorative panel of an indoor unit is lit, or voice or sound such as buzzer sound is output from a speaker provided at the indoor unit, as in an air-conditioning apparatus disclosed in Patent Literature 1. Furthermore, it is known that occurrence of a refrigerant leak is indicated on a display unit of a remote control unit that is provided to operate an indoor unit and provided in a room where the indoor unit is installed.

CITATION LIST

Patent Literature

Patent Literature 1: Japanese Unexamined Patent Application Publication No. 2016-223650

SUMMARY OF INVENTION

Technical Problem

In the air-conditioning apparatus disclosed in Patent Literature 1, if a refrigerant leak occurs, it is possible to make a notification to the effect that the refrigerant leak occurs, but it is not ensured to cause the user to fully notice the notification.

That is, in the air-conditioning apparatus disclosed in Patent Literature 1, in the case where for some reason, the user does not notice a notification indicating the refrigerant leak, even if the notification is continuously made in the same manner, the user is unlikely to be notified of the refrigerant leak. This notification method is thus insufficient as a notification method of notifying the user of refrigerant leak.

The present disclosure is applied to solve the above problem, and relates to an air-conditioning apparatus that makes various notifications indicating a refrigerant leak to cause the user to pay more attention to the notifications, whereby the user can easily notice the notifications and be fully notified of the refrigerant leak.

Solution to Problem

According to an embodiment of the present disclosure, an air-conditioning apparatus is provided with an indoor unit and an outdoor unit that are connected to each other by a refrigerant pipe through which refrigerant flows. The air-conditioning apparatus includes: a refrigerant detection unit that detects a leak of the refrigerant in the indoor unit; a notification unit that makes a notification indicating occurrence of the leak of the refrigerant; a controller that controls at least the notification unit; and a remote control unit configured to operate the indoor unit. When the refrigerant detection unit detects the leak of the refrigerant, the controller controls the notification unit to make in a first mode the notification indicating the occurrence of the leak of the refrigerant, and make the notification in a second mode different from the first mode after a predetermined time period elapses from time at which the notification in the first mode is made.

Advantageous Effects of Invention

In the air-conditioning apparatus according to the above embodiment, a notification indicating a refrigerant leak is made in two steps, that is, a step in which the first mode is applied and a step in which the second mode is applied. Therefore, it is possible to cause the user to pay more attention to the notification and thus easily notice the notification, whereby the user can be fully notified of the refrigerant leak.

DESCRIPTION OF EMBODIMENTS

An embodiment of the present disclosure will be described with reference to the drawings. It should be noted that the configurations of components described in the entire text of the specification are merely examples, and the configurations of the components are not limited to the configurations described in the entire text of the specification. The embodiment of the present disclosure can be appropriately modified without departing from the scope or idea as described in the present disclosure that can be read from the appended claims and the entire specification. Air-conditioning apparatuses of such modifications fall within the technical idea of the present disclosure. Furthermore, in each of the figures, components that are the same as or equivalent to those in a previous figure or figures are denoted by the same reference signs. The same is true of the entire text of the specification.

Embodiment 1

<Configuration of Air-Conditioning Apparatus 1>

Figure 1:
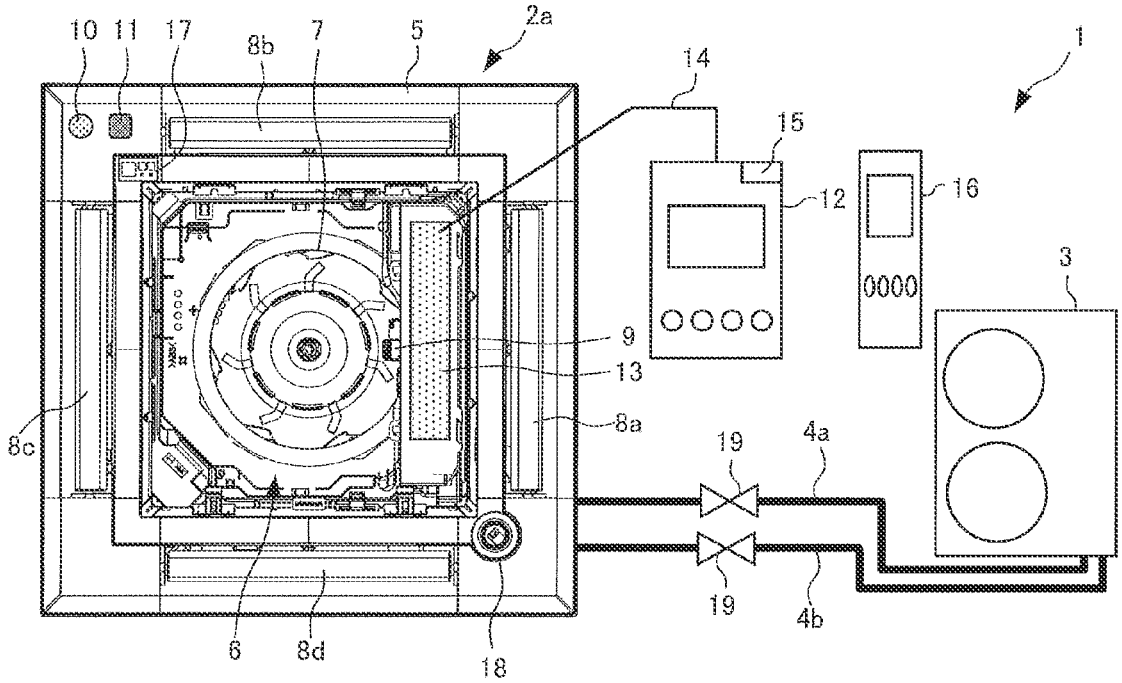
FIG. 1 is a configuration diagram illustrating an air-conditioning apparatus according to Embodiment 1 of the present disclosure.
Figure 2:
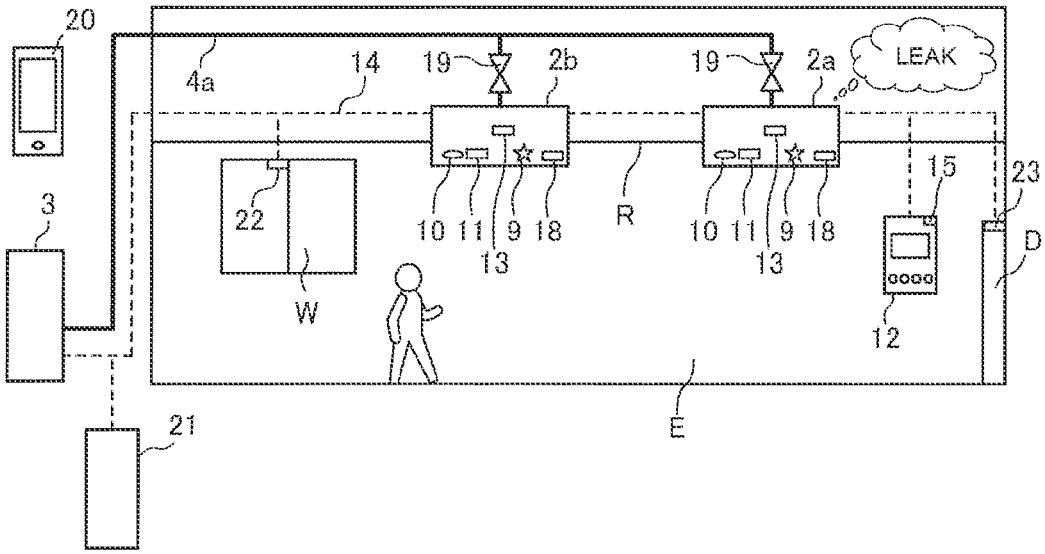
FIG. 2 is an explanatory diagram illustrating an example of installation of the air-conditioning apparatus according to Embodiment 1 of the present disclosure.

FIG. 1 is a configuration diagram illustrating an air-conditioning apparatus according to Embodiment 1 of the present disclosure. FIG. 2 is a conceptual diagram illustrating an installation state of the air-conditioning apparatus according to Embodiment 1 of the present disclosure. As illustrated in FIGS. 1 and 2, in an air-conditioning apparatus 1 according to Embodiment 1, a plurality of indoor units 2*a* and 2*b* are connected to an outdoor unit 3 by refrigerant pipes 4*a* and 4*b* through which refrigerant flows. It should be noted that one or more indoor units 2*a* and 2*b* may be provided for the outdoor unit 3. In Embodiment 1, the two indoor units 2*a* and 2*b* are provided to form a multi-split type of air conditioning apparatus 1. It should be noted that since the indoor units 2*a* and 2*b* have the same configuration, the figures excluding FIG. 2 illustrate only the indoor unit 2*a*. Similarly, regarding the refrigerant pipes 4*a* and 4*b*, FIG. 2 illustrates only the refrigerant pipe 4*a*.

The indoor units 2*a* and 2*b* are installed at a ceiling surface R of a room E that is an air-conditioned space, such that decorative panels 5 are attached to surface sides of housings that are rectangular as viewed in plan view, That is, the indoor units 2*a* and 2*b* are installed at the ceiling surface R of the single room E such that the decorative panels 5 are exposed. The decorative panels 5 are each provided as a four-way air-flow type of decorative panel that allows conditioned air to blow out in four directions. It should be noted that the indoor units 2*a* and 2*b* may be installed in the same room E or may be installed in different rooms. Furthermore, one or more indoor units 2*a* and 2*b* are installed in the single room E. The type of each decorative panel 5 is not limited to the four-way air-flow type, and may be a two-way air-flow type, and various other types of decorative panels can be used as the decorative panel 5.

In a central portion of each of the indoor units 2*a* and 2*b*, an air inlet 6 is provided to suck indoor air. At the back of the air inlet 6, an air-sending device 7 is provided. The air-sending device 7 is, for example, a fan. Furthermore, four air outlets for blowing out conditioned air subjected to heat exchange in four directions are provided around the air inlet 6. At the four air outlets, respective louvers 8*a* to 8*d* for controlling the blowing direction of the conditioned air are provided.

At each of the indoor units 2*a* and 2*b*, a refrigerant sensor 9 is provided as a refrigerant detection unit that detects a refrigerant leak. The refrigerant sensor 9 is a gas sensor that detects the presence of HFC32 or refrigerant gas, such as LP gas, which can be used as refrigerant for environmental protection in the future, and outputs data on the concentration of the detected gas as a sensor output (ppm). The refrigerant sensor 9 may be, for example, a semiconductor gas sensor that detects a gas leak from reduction of the electrical resistance of a detection portion that is caused by separation of oxygen atoms from the detection portion that occurs when, for example, reducing gas comes into contact with the detection portion.

Furthermore, in each of the indoor units 2*a* and 2*b*, a display unit 10 and a speaker 11 are provided at the decorative panel 5, and each of the display unit 10 and the speaker 11 is a notification unit that makes a notification indicating occurrence of a refrigerant leak, when the refrigerant leak is detected by the refrigerant sensor 9. In Embodiment 1, the display unit 10 is a light emitting diode (LED), but is not limited to the LED. The display unit 10 and the speaker 11 are disposed adjacent to each other at the decorative panel 5. Because of this arrangement, as notifications indicating a refrigerant leak, light from the display unit 10 and sound from the speaker 11 are emitted from adjacent areas, thereby enabling the user to pay more attention to the notifications. (Moreover, since the display unit 10 and the speaker 11 are disposed adjacent to each other, at the time of performing maintenance, it is easy to replace each of the display unit 10 and the speaker 11 with a new one, if necessary. It is therefore possible to improve the serviceability.

Moreover, in Embodiment 1, for each of the indoor units 2*a* and 2*b*, a wired remote control unit 12 is connected to a controller 13 by a wire 14. The remote control unit 12 allows the indoor unit to be turned on/off, and allows detailed settings of a temperature, an air volume, an air-flow direction, a timer, etc., to be performed The remote control unit 12 is also connected to the outdoor unit 3 by a wire 14.

The remote control unit 12 is provided with a communication unit 15 that can communicate with an external terminal device 20 via a network. Specifically, the network between the communication unit 15 and the external terminal device 20 may be a near field communication network such as a wireless local area network (LAN) or Bluetooth (registered trademark), or another kind of communication network such as the Internet or mobile phone networks.

The controller 13 is connected to the display unit 10, the speaker 11, and the external terminal device 20 by wires or wirelessly. When the refrigerant sensor 9 detects a refrigerant leak, the controller 13 controls at least one of the display unit 10 and the speaker 11 to make a notification indicating occurrence of a refrigerant leak, and also controls the external terminal device 20 to make a notification indicating occurrence of the refrigerant leak, via the communication unit 15. The external terminal device 20 may be any of various terminals, such as a personal computer, a smart phone, and a tablet terminal, which can make a notification using, for example, sound, light, or a display. The controller 13 is also connected to a management device 21 that manages the operation state of the air-conditioning apparatus 1, via the communication unit 15 and the wire 14. It should be noted that the communication unit 15 and the management device 21 may be set capable of communicating with each other via a network.

In each of the indoor units 2*a* and 2*b*, a light receiving unit 17 is provided at the decorative panel 5, and receives an operation signal that is transmitted from a wireless remote control unit 16 that allows simple air-conditioning settings of a temperature, an air volume, an air-flow direction, etc. Furthermore, in each of the indoor units 2*a* and 2*b*, a human sensor 18 is also provided at the decorative panel 5, and detects a person who is present in the vicinity of the indoor unit. The light receiving unit 17 and the human sensor 18 are located opposite to each other at the decorative panel 5. The light receiving unit 17 is located adjacent to the display unit 10 and the speaker 11 at the decorative panel 5. In such a manner, since the light receiving unit 17 is located adjacent to the display unit 10 and the speaker 11, at the time of performing maintenance, it is easy to replace these components with new ones, thereby improving the serviceability. In addition, since the display unit 10 and the speaker 11 are disposed apart from the human sensor 18, it is possible to prevent occurrence of an error in temperature detection by the human sensor 18, which would occur due to the heat generated by the display unit 10 and the speaker 11.

It should be noted that although it is described above that the communication unit 15 is provided at the remote control unit 12, it is not limiting. The communication unit 15 may be provided at the remote control unit 16, or communication units 15 may be provided at both the remote control units 12 and 16, or the communication unit 15 may be provided at the decorative panel 5. Although it is described above that at each of the indoor units 2*a* and 2*b*, the display unit 10 and the speaker 11 serving as notification units are provided at the decorative panel 5, it is not limiting. The display unit 10 and the speaker 11 may be provided at either or both of the remote control units 12 and 16.

At the refrigerant pipes 4*a* and 4*b* that respectively connecting the indoor units 2*a* and 2*b* to the outdoor unit 3, respective shut-off valves 19 are provided to cut off the flow of refrigerant between the indoor unit 2*a* and the outdoor unit 3 and between the indoor unit 2*b* and the outdoor unit 3. When a refrigerant leak is detected by the refrigerant sensor 9, the state of the shutoff valve 19 is switched from the open state to the closed state by the controller 13, thereby isolating one of the indoor unit 2*a* and 2*b* in which the refrigerant leak occurs from the other indoor unit.

That is, when a refrigerant leak is detected by the refrigerant sensor 9, the controller 13 perform a control operation to switch the state of the shutoff valve 19 from the open state to the closed state to isolate the indoor unit 2*a* (2*b*) in which the refrigerant leak occurs from the other indoor unit 2*b* (2*a*), in addition to a control operation regarding a notification indicating occurrence of the refrigerant leak. Thus, it is possible to avoid the spread of the refrigerant leak.

When a refrigerant leak is detected by the refrigerant sensor 9, the controller 13 perform a control operation to forcibly operate the air-sending device 7 of each of the indoor units 2*a* and 2*b*, in addition to the control operation regarding a notification indicating occurrence of the refrigerant leak. The above "forcibly operate" means operating the air-sending device 7 of each of the indoor units 2*a* and 2*b* to cause the air-sending device 7 to send a strong wind, regardless of whether the air-sending device 7 is in the stopped state or in operation. As a result, it is possible to diffuse the refrigerant that leaks into the room E, and prevent accumulation of the refrigerant in a given region and an increase in the concentration of the refrigerant in the given region. Furthermore, when a refrigerant leak is detected by the refrigerant sensor 9, it is possible to effectively prevent the spread of the refrigerant leak by performing both a forced operation of the air-sending device 7 of each of the indoor units 2*a* and 2*b* and isolation of one of the indoor unit 2*a* and 2*b* in which the refrigerant leak occurs from the other, is achieved by the shutoff valve 19.

In Embodiment 1, opening/closing detection units 22 and 23 are provided, respectively, at a window W and a door D of the room E in which the indoor units 2*a* and 2*b* are installed. The opening/closing detection units 22 and 23 are configured to detect opening and closing of the window W and the door D. The opening/closing detection units 22 and 23 are connected to the controller 13 by wires 14.

Furthermore, it is preferable that an indication that the window W or the door D of the room E in which the refrigerant leak occurs should be opened be added to the notification indicating occurrence of the refrigerant leak. Thus, when a refrigerant leak is detected by the refrigerant sensor 9, it is possible to diffuse the refrigerant that leaks into the room E and prevent accumulation of the refrigerant in a given region and an increase in the concentration of the refrigerant in the given region, by the control operation performed by the controller 13 to make a notification indicating occurrence of the refrigerant leak.

<Regarding Notification of Refrigerant Leak>

Figure 3:
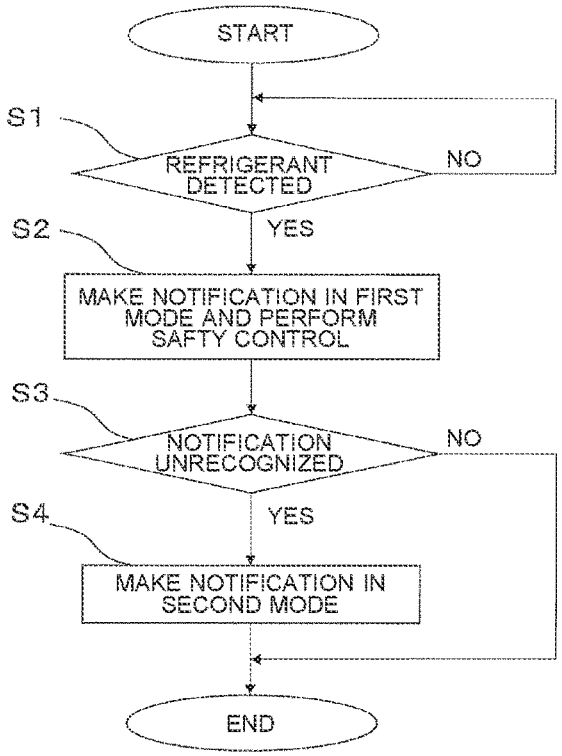
FIG. 3 is a flowchart indicating the procedure of a refrigerant-leak notification process in the air-conditioning apparatus as illustrated in FIG. 1.

The procedure of a refrigerant-leak notification process in the air-conditioning apparatus 1 according to Embodiment 1 will be described. FIG. 3 is a flowchart indicating the procedure of a refrigerant-leak notification process in the air-conditioning apparatus 1 as illustrated in FIG. 1.

In step S1, the controller 13 determines whether a refrigerant leak is detected by the refrigerant sensor 9 or not. This process is repeated until an affirmative result is obtained. When an affirmative result is obtained (Yes in S1), the process proceeds to step S2.

In step S2, the controller 13 controls the display unit 10, the speaker 11, and the external terminal device 20 to make notifications indicating occurrence of the refrigerant leak in a first mode, and performs a safety control. The safety control is a control to prevent the spread of the refrigerant leak or prevent the refrigerant from being present in a given area at a high concentration, by switching the state of the shutoff valve 19 to the closed state, forcibly operating the air-sending device 7, or making a notification that indicates that the window W or the door D of the room E is to be opened. It should be noted that the description of the safety control will be omitted since it overlaps the above description.

Specifically, when a refrigerant leak is detected by the refrigerant sensor 9, the controller 13 controls the display unit 10, the speaker 11, and the external terminal device 20 to make notifications in the first mode as described below. Of the notifications made in the first mode, a notification by the display unit 10 is made by, for example, lighting a lamp such as a worming lamp or causing the lamp to blink to notify the user of the refrigerant leak. Alternatively, the notification by the display unit 10 may be made by displaying characters or an image indicating the refrigerant leak on the display unit to notify the user of refrigerant leak. Furthermore, a notification by the speaker 11 is made by, for example, making warning sound such as buzzer sound, or making a voice announcement indicating the refrigerant leak, to notify the user of the refrigerant leak. Alternatively, the notification by the speaker 11 may be made by applying a combination of sound, light, and a display with both the display unit 10 and the speaker 11 to notify the user of the refrigerant leak. A notification using the external terminal device 20 may be made by emitting sound or light, or make a display, or apply a combination of sound, light, and the display to notify the user of the refrigerant leak. Furthermore, regarding the indoor unit 2*a* (2*b*) in which the refrigerant leak occurs, a notification may be made in a different manner from the manner of a notification regarding the other indoor unit, that is, the indoor unit 2*b* (2*a*). The notifications made in the different manners are notifications made by, for example, causing the display units 10 of the indoor units 2*a* and 2*b* to emit light having different colors, to blink with different frequencies or at different timings, or to display different messages or different images. Furthermore, the notifications made in the different manners are notifications made by, for example, causing the speakers 11 of the indoor units 2*a* and 2*b* to make different buzzer sound or give different messages.

Next, the process by the controller 13 proceeds to step S3. In step S3, the controller 13 determines whether or not the notification in the first mode is recognized by the user within the predetermined time period of the notification in the first mode. In step S3, when an operation is performed by the remote control unit 12 or 16 (No in step S3), the controller 13 determines that the user recognizes (the user notices) the notification in the first mode, and the refrigerant-leak notification process ends.

It should be noted that the criterion on which the controller 13 determines that the notification in the first mode is recognized is not limited to the above. The controller 13 may determine that the notification in the first mode is recognized, when the human sensor 18 does not detect a user (person) in the vicinity of the indoor unit 2*a* or 2*b* after the predetermined time period elapses from the time at which the notification in the first mode is made. Alternatively, the controller 13 may determine that the notification in the first mode is recognized, when the opening/closing detection unit 22 or 23 detects that the window W or the door D is in opened state, within the predetermined time period of the notification in the first mode.

By contrast, in step S3, when the controller 13 determines that the notification in the first mode is not recognized by the user after the predetermined time period elapses from the time at which the notification in the first mode is made (Yes in S3), the process proceeds to step S4. Then, in step S4, the controller 13 controls the display unit 10, the speaker 11, and the external terminal device 20 to make notifications indicating occurrence of the refrigerant leak in a second mode different from the first mode. The notification in the second mode is a notification that is made by outputting buzzer sound or voice from the speaker 11 in a larger volume, than the notification in the first mode. Alternatively, the notification in the second mode is a notification that is made by lighting a lamp such as a warning lamp, causing the lamp to blink, or displaying a message (displaying characters or an image) at a higher brightness on the display unit 10, or a notification that is made by causing the lamp to blink with a higher frequency on the display unit 10, than the notification in the first mode.

To be more specific, when the operation by the remote control unit 12 or 16 is not performed even after the predetermined time period elapses from the time at which the notification in the first mode is made, the controller 13 controls the display unit 10, the speaker 11, and the external terminal device 20 to make the notifications in the second mode.

It should be noted that the criterion on which the controller 13 determines that the notification in the first mode is not recognized is not limited to the above. The controller 13 may determine that the notification in the first mode is not recognized, when the human sensor 18 detects a person (user) in the vicinity of the indoor unit 2*a* after the predetermined time period elapses from the time at which the notification in the first mode is made.

The controller 13 may determine that the notification is not recognized, when opening/closing of the window W or the door D is not detected by the opening/closing detection unit 22 or 23 even after the predetermined time period elapses from the time at which the notification in the first mode is made.

After controlling the notification in the second mode in step S4, the controller 13 ends the refrigerant-leak notification process.

<Regarding Refrigerant Circuit>

Figure 4:
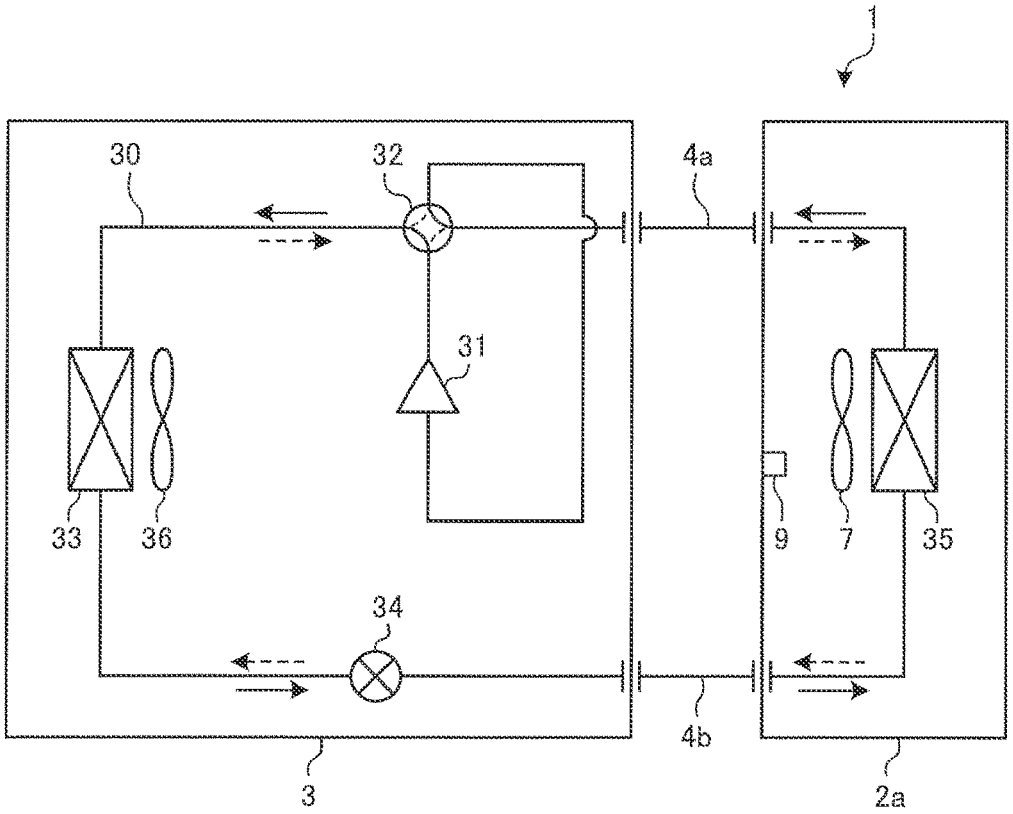
FIG. 4 is a schematic diagram indicating a refrigerant circuit of the air-conditioning apparatus according to Embodiment 1 of the present disclosure.

FIG. 4 is a schematic diagram indicating a refrigerant circuit of the air-conditioning apparatus 1 according to Embodiment 1 of the present disclosure. Since the indoor units 2*a* and 2*b* have the same configuration, only the indoor unit 2*a* will be indicated and described as a matter of convenience. As shown in FIG. 4, in the air-conditioning apparatus 1, heat is transferred between outside air and indoor air through refrigerant, thereby heating or cooling the room to achieve air conditioning. The air-conditioning apparatus 1 includes the outdoor unit 3 and the indoor unit 2*a*.

In the air-conditioning apparatus 1, the outdoor unit 3 and the indoor unit 2*a* are connected by the refrigerant pipes 4*a* and 4*b* to form a refrigerant circuit 30 in which refrigerant circulates. In the refrigerant circuit 30 of the air-conditioning apparatus 1, a compressor 31, a flow switching device 32, an outdoor heat exchanger 33, an expansion valve 34, and an indoor heat exchanger 35 are connected by the refrigerant pipes 4*a* and 4*b*.

The outdoor unit 3 includes the compressor 31 the flow switching device 32, the outdoor heat exchanger 33, and the expansion valve 34. The compressor 31 compresses sucked refrigerant and discharges the compressed refrigerant. The compressor 31 may include an inverter device, and be configured such that the inverter device changes the operating frequency, thereby changing the capacity of the compressor 31. It should be noted that the capacity of the compressor 31 is the amount of refrigerant that is sent from the compressor 31 per unit time. The flow switching device 32 is, for example, a four-way valve, and switches the flow direction of the refrigerant that flows through a refrigerant flow passage, between a plurality of flow directions.

The air-conditioning apparatus 1 switches the flow direction of the refrigerant using the flow switching device 32 in response to an instruction from the controller 13 (FIG. 1), thereby performing a heating operation or a cooling operation. The outdoor heat exchanger 33 causes heat exchange to be performed between refrigerant and outdoor air. During the heating operation, the outdoor heat exchanger 33 operates as an evaporator, and causes heat exchange between low-pressure refrigerant that has flowed thereinto from the refrigerant pipe 4*b* and outdoor air to evaporate and gasify the refrigerant, and discharges the refrigerant toward the refrigerant pipe 4*a*. During the cooling operation, the outdoor heat exchanger 33 operates as a condenser, and causes heat exchange to be performed between the refrigerant that has been compressed by the compressor 31 and flowed from the flow switching device 32 into the outdoor heat exchanger 33 and outdoor air to condense and liquefy the refrigerant. For the outdoor heat exchanger 33, an outdoor fan 36 is provided to increase the heat exchange efficiency between the refrigerant and outdoor air, To the outdoor fan 36, an inverter device may be attached, to change the operating frequency of a fan motor and thereby change the rotation speed of the fan. The expansion valve 34 is an expansion device (flow-rate control unit) that operates as an expansion valve that adjusts the flow rate of refrigerant that flows through the expansion valve 34, and is adjusted in opening degree to adjust the pressure of the refrigerant. For example, in the case where the expansion valve 34 is an electronic expansion valve, the opening degree of the expansion valve 34 is adjusted in response to an instruction from the controller 13 (FIG. 1) or other units.

The indoor unit 2*a* includes the indoor heat exchanger 35 that causes heat exchange to be performed between the refrigerant and indoor air, and the air-sending device 7 that adjusts the flow of air to be subjected to the heat exchange at the indoor heat exchanger 35. The indoor unit 2*a* further includes the refrigerant sensor 9 that detects a leak of refrigerant for use in the refrigerant circuit 30.

During the heating operation, the indoor heat exchanger 35 operates as a condenser, causes heat exchange to be performed between the refrigerant that has flowed thereinto from the refrigerant pipe 4*a* and indoor air to condense and liquefy the refrigerant, and causes the refrigerant to flow out to the refrigerant pipe 4*b*. During the cooling operation, the indoor heat exchanger 35 operates as an evaporator, causes heat exchange to be performed between the refrigerant the pressure of which is reduced to a low level by the expansion valve 34 and outdoor air, to cause the refrigerant to absorb heat from the air, thereby evaporating and gasifying the refrigerant, and causes the refrigerant to flow out to the refrigerant pipe 4*a*. The operation speed of the air-sending device 7 is determined by the user's setting. To the air-sending device 7, an inverter device may be attached to change the operating frequency of a fan motor and thereby change the rotation speed of the fan.

<Examples of Cooling and Heating Operations of Air-Conditioning Apparatus 1>

An example of the cooling operation of the air-conditioning apparatus 1 will be described. High-temperature and high-pressure gas refrigerant compressed and discharged by the compressor 31 flows into the outdoor heat exchanger 33 via the flow switching device 32. The gas refrigerant that has flowed into the outdoor heat exchanger 33 condenses through heat exchange with outside air sent by the outdoor fan 36 to change into low-temperature refrigerant, and the low-temperature refrigerant then flows out of the outdoor heat exchanger 33. The refrigerant discharged from the outdoor heat exchanger 33 is expanded and reduced to in pressure by the expansion valve 34 to change into low-temperature and low-pressure two-phase gas-liquid refrigerant. The two-phase gas-liquid refrigerant flows into the indoor heat exchanger 35 of the indoor unit 2*a*, and evaporates through heat exchange with indoor air sent by the air-sending device 7 to change into low-temperature and low-pressure gas refrigerant, and the low-temperature and low-pressure gas refrigerant then flows out of the indoor heat exchanger 35. At this time, the indoor air that is cooled since heat is absorbed from the indoor air by the refrigerant is blown as conditioned air (blowing air) from the indoor unit 2*a* into the room E that is the air-conditioned space (FIG. 2). The gas refrigerant that has flowed out of the indoor heat exchanger 35 is sucked into the compressor 31 via the flow switching device 32, and re-compressed by the compressor 31. In the cooling operation of the air-conditioning apparatus 1, the above operations (as indicated by solid lines in FIG. 4) are repeated.

An example of the heating operation of the air-conditioning apparatus 1 will be described. High-temperature and high-pressure gas refrigerant compressed and discharged by the compressor 31 flows into the indoor heat exchanger 35 of the indoor unit 2*a* via the flow switching device 32. The gas refrigerant that has flowed into the indoor heat exchanger 35 condenses through heat exchange with indoor air sent by the air-sending device 7 to change into low-temperature refrigerant, and the low-temperature refrigerant then flows out of the indoor heat exchanger 35. At this time, the indoor air heated by heat received from the gas refrigerant is blown as conditioned air (blowing air) from the indoor unit 2*a* into the room E (FIG. 2). The refrigerant discharged from the indoor heat exchanger 35 is expanded and reduced in pressure by the expansion valve 34 to change into low-temperature and low-pressure two-phase gas-liquid refrigerant. The two-phase gas-liquid refrigerant flows into the outdoor heat exchanger 33 of the outdoor unit 3, and evaporates through heat exchange with outside air sent by the outdoor fan 36 to change into low-temperature and low-pressure gas refrigerant, and the low-temperature and low-pressure gas refrigerant flows out of the outdoor heat exchanger 33. The gas refrigerant that has flowed out of the outdoor heat exchanger 33 is sucked into the compressor 31 via the flow switching device 32, and re-compressed by the compressor 31. In the heating operation of the air-conditioning apparatus 1, the above operations (indicated by dashed lines in FIG. 4) are repeated.

Advantages of Embodiment 1

As described above, in the air-conditioning apparatus 1 according to Embodiment 1, when a refrigerant leak is detected by the refrigerant sensor 9, the controller 13 causes a notification indicating occurrence of the refrigerant leak to be made in the first mode. Furthermore, after the predetermined time period elapses from the time at which the notification in the first mode is made, the controller 13 controls the display unit 10, the speaker 11, and the external terminal device 20 to make the notifications in the second mode different from the first mode. In such a manner, the air-conditioning apparatus 1 makes the notifications indicating occurrence of the refrigerant leak in two steps, that is, the step in which the first mode is applied and the step in which the second mode is applied. That is, the notifications indicating occurrence of the refrigerant leak are made in different modes, i.e., the notifications are not continued in the same mode. It is therefore possible to cause the user to pay more attention to the notifications, and thus easily notice the notifications, thereby making the user fully aware of the refrigerant leak.

Furthermore, for the indoor unit 2*a* (2*b*) in which the refrigerant leak is detected by the refrigerant sensor 9 and the other indoor unit 2*b* (2*a*), the controller 13 may control the display unit 10, the speaker 11, and the external terminal device 20 to make in different manners the notifications indicating occurrence of the refrigerant leak. It is therefore possible to make the notifications such that the indoor unit 2*a* (2*b*) in which the refrigerant leak occurs is distinguished from the other indoor unit 2*b* (2*a*), and to easily identify the indoor unit 2*a* (2*b*) in which the leak occurs, when performing maintenance.

Modifications

Modifications of the decorative panel 5 of the indoor unit 2*a* of the air-conditioning apparatus 1 as illustrated in FIG. 1 will be described with reference to FIGS. 5 to 11. It should be noted that the following description refers to the arrangement of the display unit 10, the speaker 11, the light receiving unit 17, and the human sensor 18 at the decorative panel 5. The other configurations are the same as those in Embodiment 1 described above, and their descriptions will thus be omitted. Also, since the indoor units 2*a* and 2*b* have the same configuration, only the indoor unit 2*a* is illustrated and will be described as a matter of convenience.

Figure 5:
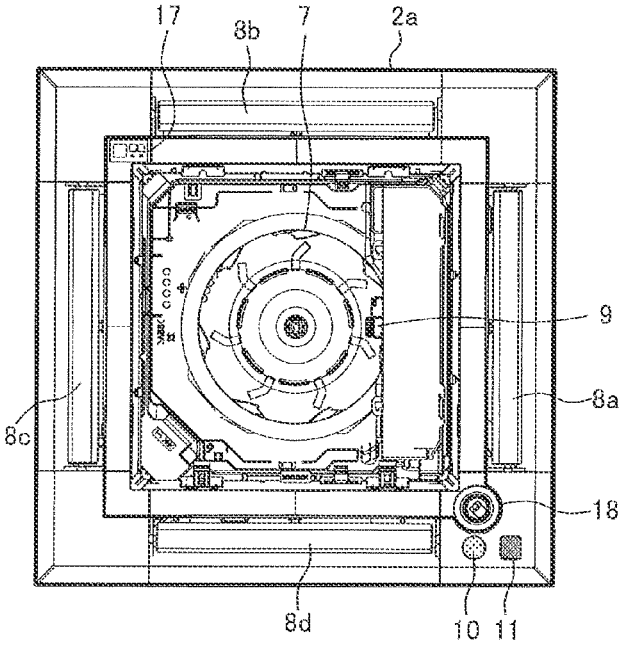
FIG. 5 is a plan view illustrating a modification of an indoor unit of the air-conditioning apparatus as illustrated in FIG. 1.

FIG. 5 is a plan view illustrating a modification of the indoor unit 2*a* of the air-conditioning apparatus 1 as illustrated in FIG. 1, In this modification, at the decorative panel 5, the light receiving unit 17 and the human sensor 18 are provided diagonally opposite to each other, and the display unit 10 and the speaker 11 are located adjacent to the human sensor 18. Because of this arrangement, as notifications indicating occurrence of a refrigerant leak, light from the display unit 10 and sound from the speaker 11 are emitted from adjacent places, that is, from the display unit 10 and the speaker that are arranged adjacent to each other, and it is therefore to cause the user to pay more attention to the notifications. Furthermore, since the display unit 10, the speaker 11 and the human sensor 18 are adjacent to each other, it is possible to more easily replace each of the display unit 10, the speaker 11, and the human sensor 18 with a new one, when performing maintenance, thereby improving the serviceability.

Figure 6:
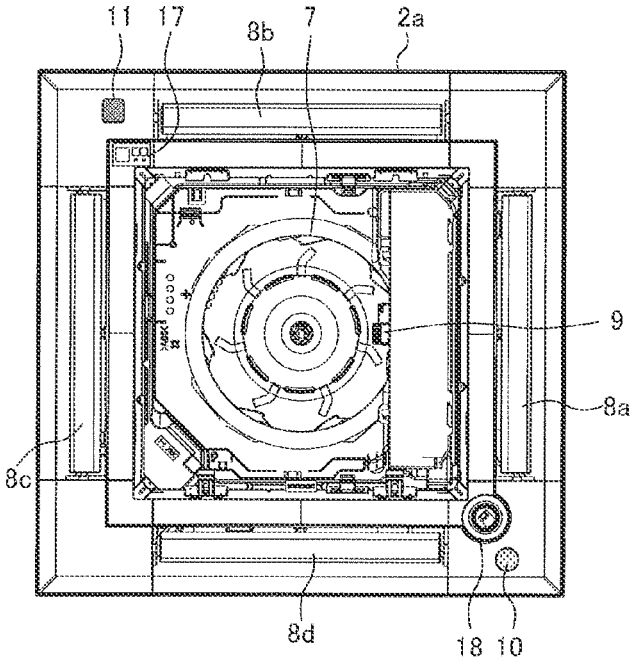
FIG. 6 is a plan view illustrating another modification of the indoor unit of the air-conditioning apparatus as illustrated in FIG. 1.

FIG. 6 is a plan view illustrating another modification of the indoor unit 2*a* of the air-conditioning apparatus 1 as illustrated in FIG. 1. In this modification, at the decorative panel 5, the light receiving unit 17 and the human sensor 18 are provided diagonally opposite to each other, the display unit 10 is located adjacent to the human sensor 18, and the speaker 11 is located adjacent to the light receiving unit 17. Because of this arrangement, as notifications indicating occurrence of a refrigerant leak, light from the display unit 10 and sound from the speaker 11 are emitted from diagonally opposite places, and the notifications are thus made in a diffuse manner. It is therefore possible to cause the user to pay more attention to the notifications. Furthermore, since the display unit 10 and the human sensor 18 are located adjacent to each other, and the speaker 11 and the light receiving unit 17 are located adjacent to each other, it is easy to replace each of components with a new one when performing maintenance. It is therefore possible to improve the serviceability.

Figure 7:
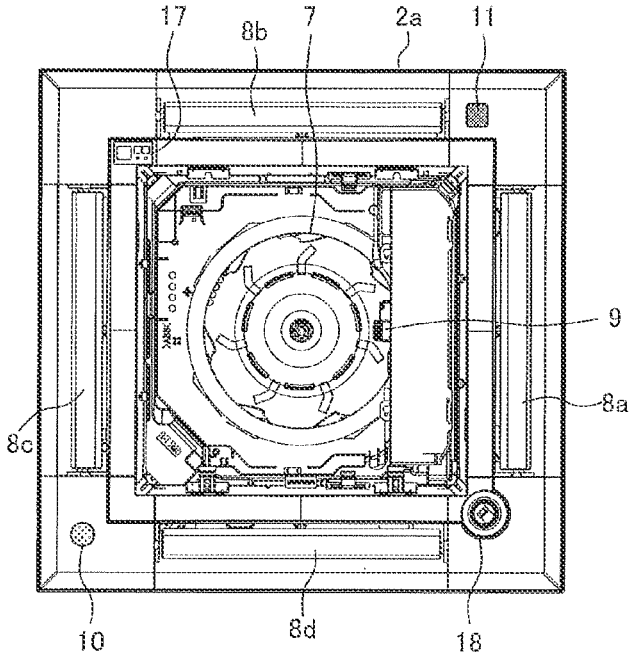
FIG. 7 is a plan view illustrating a further modification of the indoor unit of the air-conditioning apparatus as illustrated in FIG. 1.

FIG. 7 is a plan view illustrating a further modification of the indoor unit 2*a* of the air-conditioning apparatus 1 as illustrated in FIG. 1. In this modification, at the decorative panel 5, the light receiving unit 17 and the human sensor 18 are provided diagonally opposite to each other, and the display unit 10 and the speaker 11 are provided diagonally opposite each other such that a diagonal line connecting the display unit 10 and the speaker 11 is perpendicular to a diagonal line connecting the light receiving unit 17 and the human sensor 18. That is, at the decorative panel 5, the display unit 10, the speaker 11, the light receiving unit 17, and the human sensor 18 are all located apart from each other. Because of this arrangement, as notifications indicating the refrigerant leak, light from the display unit 10 and sound from the speaker 11 are emitted from diagonally opposite places, and the notifications are thus made in a diffuse manner, whereby it is possible to cause the user to pay more attention to the notifications. Moreover, since the display unit 10 and the speaker 11 are located apart from the human sensor 18, it is possible to prevent an error from occurring in temperature detection by the human sensor 18 due to the heat generated by the display unit 10 and the speaker 11.

Figure 8:
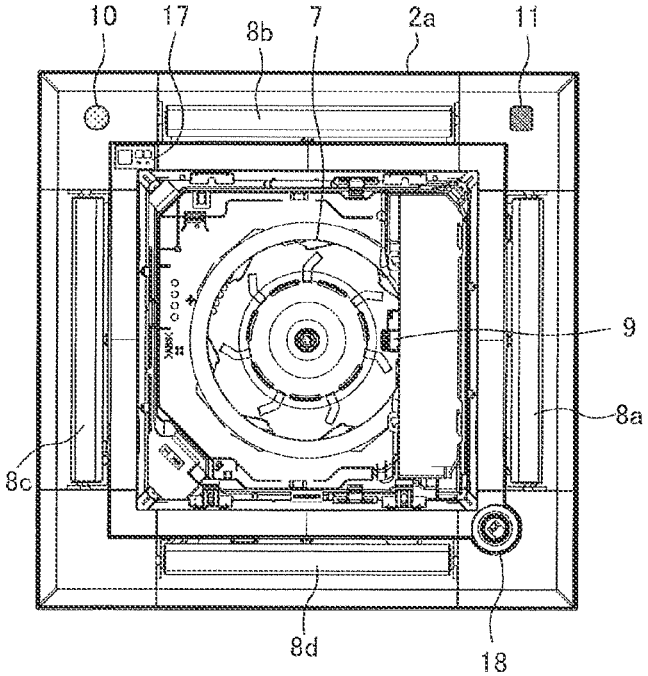
FIG. 8 is a plan view illustrating still another modification of the indoor unit of the air-conditioning apparatus as illustrated in FIG. 1.

FIG. 8 is a plan view illustrating still another modification of the indoor unit 2*a* of the air-conditioning apparatus 1 as illustrated in FIG. 1. In this modification, at the decorative panel 5, the light receiving unit 17 and the human sensor 18 are provided diagonally opposite to each other, the display unit 10 is provided adjacent to the light receiving unit 17, and the speaker 11 is provided apart from the light receiving unit 17 and the human sensor 18. Because of this arrangement, as notifications indicating occurrence of a refrigerant leak, light from the display unit 10 and sound from the speaker 11 are emitted from separated places and in a diffuse manner. It is therefore possible to cause the user to pay more attention to the notifications. Furthermore, since the display unit 10 and the light receiving unit 17 are located adjacent to each other, it is easy to replace each of components with a new one when performing maintenance, thereby improving the serviceability. In addition, since the display unit 10, the speaker 11, and the light receiving unit 17 are located apart from the human sensor 18, it is possible to prevent an error from occurring in temperature detection by the human sensor 18 due to the heat generated by the display unit 10 and the speaker 11.

Figure 9:
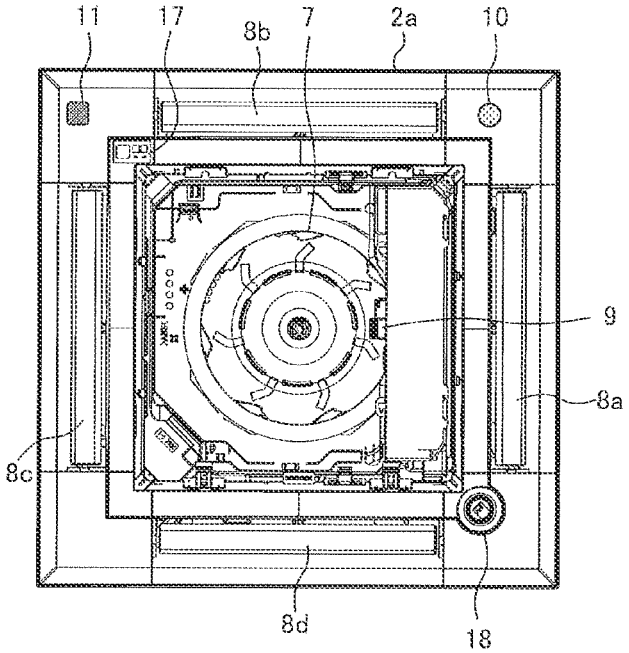
FIG. 9 is a plan view illustrating a still further modification of the indoor unit of the air-conditioning apparatus as illustrated in FIG. 1.

FIG. 9 is a plan view illustrating a still further modification of the indoor unit 2*a* of the air-conditioning apparatus 1 as illustrated in FIG. 1. In this modification, at the decorative panel 5, the light receiving unit 17 and the human sensor 18 are provided diagonally opposite to each other, the speaker 11 is provided adjacent to the light receiving unit 17, and the display unit 10 is provided apart from the light receiving unit 17 and the human sensor 18. Because of this arrangement, as notifications indicating a refrigerant leak, light from the display unit 10 and sound from the speaker 11 are emitted from separated places and in a diffuse manner. It is therefore possible to cause the user to pay more attention to the notifications. Furthermore, since the speaker 11 and the light receiving unit 17 are provided adjacent to each other, it is easy to replace each of components with a new one when performing maintenance. It is therefore possible to improve the serviceability. In addition, since the display unit 10, the speaker 11, and the light receiving unit 17 are provided apart from the human sensor 18, it is possible to prevent an error from occurring in temperature detection by the human sensor 18 due to the heat generated by the display unit 10 and the speaker 11.

Figure 10:
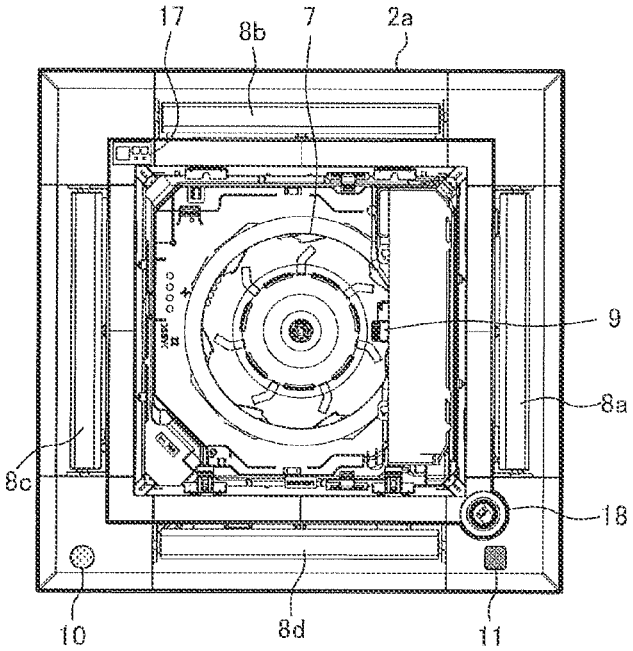
FIG. 10 is a plan view illustrating yet another modification of the indoor unit of the air-conditioning apparatus as illustrated in FIG. 1.

FIG. 10 is a plan view illustrating yet another modification of the indoor unit 2*a* of the air-conditioning apparatus 1 as illustrated in FIG. 1. In this modification, at the decorative panel 5, the light receiving unit 17 and the human sensor 18 are provided diagonally opposite to each other, the speaker 11 is provided adjacent to the human sensor 18, and the display unit 10 is provided apart from the light receiving unit 17 and the human sensor 18. Because of this arrangement, as notifications indicating a refrigerant leak, light from the display unit 10 and sound from the speaker 11 are emitted from separated places and in a diffuse manner. It is therefore possible to cause the user to pay more attention to the notifications. Furthermore, since the speaker 11 and the human sensor 18 are provided adjacent to each other, it is easy to replace each of components with a new one when performing maintenance, and is therefore possible to improve the serviceability.

Figure 11:
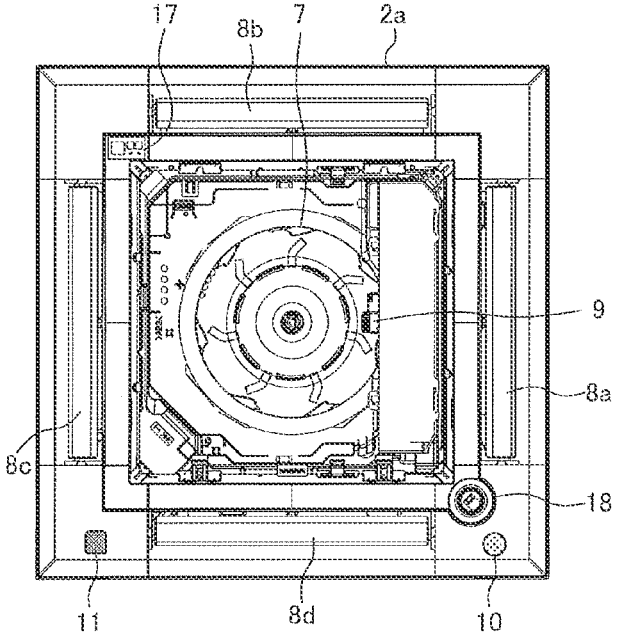
FIG. 11 is a plan view illustrating a yet further modification of the indoor unit of the air-conditioning apparatus as illustrated in FIG. 1.

FIG. 11 is a plan view illustrating a yet further modification of the indoor unit 2*a* of the air-conditioning apparatus 1 as illustrated in FIG. 1. In this modification, at the decorative panel 5, the light receiving unit 17 and the human sensor 18 are provided diagonally opposite to each other, the display unit 10 is provided adjacent to the human sensor 18, and the speaker 11 is provided apart from the light receiving unit 17 and the human sensor 18. Because of this arrangement, as notifications indicating occurrence of a refrigerant leak, light from the display unit 10 and sound from the speaker 11 are emitted from separated places and in a diffuse manner. It is therefore possible to cause the user to pay more attention to the notifications. Furthermore, since the display unit 10 and the human sensor 18 are provided adjacent to each other, it is easy to replace each of components with a new one when performing maintenance, and is therefore possible to improve the serviceability.

REFERENCE SIGNS LIST

1 air-conditioning apparatus, 2*a*, 2*b* indoor unit, 3 outdoor unit, 4*a*, 4*b* refrigerant pipe, 5 decorative panel, 6 air inlet, 7 air-sending device, 8*a*, 8*b*, 8*c*, 8*d* louver, 9 refrigerant sensor, 10 display unit, 11 speaker, 12, 16 remote controller, 13 controller, 14 wire, 15 communication unit, 17 light receiving unit, 18 human sensor, 19 shutoff valve, 20 terminal device, 21 management device, 22 opening/closing detection unit, 23 opening/closing detection unit, 30 refrigerant circuit, 31 compressor, 32 flow switching device, 33 outdoor heat exchanger, 34 expansion valve, 35 indoor heat exchanger, 36 outdoor fan, D door, E room, R ceiling surface, W window

The invention claimed is:

1. An air-conditioning apparatus provided with an indoor unit and an outdoor unit that are connected to each other by a refrigerant pipe through which refrigerant flows, the air-conditioning apparatus comprising:

a refrigerant detector configured to detect a leak of the refrigerant in the indoor unit;

notification circuitry configured to make a notification indicating occurrence of the leak of the refrigerant;

a controller configured to control at least the notification circuitry; and a remote control configured to operate the indoor unit, wherein when the refrigerant detector detects the leak of the refrigerant, the controller controls the notification circuitry to make a first mode notification indicating the occurrence of the leak of the refrigerant, makes a determination whether the first mode notification has been recognized or not, and controls the notification circuitry to make a second mode notification different from the first mode notification based on a result of the determination.

2. The air-conditioning apparatus of claim 1, wherein the controller is configured to control the notification circuitry to make the second mode notification when the determination determines that an operation by the remote control is not performed within a predetermined time period since the first mode notification was made.

3. The air-conditioning apparatus of claim 1, further comprising:

a human sensor configured to detect a presence of a person in a vicinity of the indoor unit, wherein the controller controls the notification circuitry to make the second mode notification indicating the occurrence of the leak of the refrigerant when the determination determines that the human sensor detects the presence of the person in the vicinity of the indoor unit after a predetermined time period has elapsed since when the first mode notification was made.

4. The air-conditioning apparatus of claim 1, further comprising:

an opening/closing detector configured to detect opening/closing of a window or a door of a room in which the indoor unit is installed, wherein the controller controls the notification circuitry to make the second mode notification indicating the occurrence of the leak of the refrigerant when the determination determines that the opening/closing detection unit does not detect the opening/closing of the window or the door within a predetermined time period since the first mode notification was made.

5. The air-conditioning apparatus of claim 1, wherein:

the notification circuitry includes at least one of the remote control and a display unit or a speaker that is provided at a surface of a housing of the indoor unit;

the first mode notification includes at least one of a notification that is made by outputting buzzer sound or voice from the speaker or the remote control and a notification that is made by lighting a lamp, causing the lamp to blink, or displaying a message on the display unit or the remote control; and the second mode notification includes at least one of a notification that is made by outputting buzzer sound or voice in a larger volume, a notification that is made by lighting the lamp, causing the lamp to blink, or displaying the message at a higher brightness, and a notification that is made by causing the lamp to blink with a higher frequency, than the first mode notification.

6. The air-conditioning apparatus of claim 1, further comprising:

a shutoff valve provided at the refrigerant pipe, the shutoff valve configured to shut off a flow of the refrigerant between the indoor unit and the outdoor unit, wherein when the refrigerant detector detects the leak of the refrigerant, the controller switches a state of the shutoff valve from an open state to a closed state.

7. The air-conditioning apparatus of claim 1, wherein when the refrigerant detector detects the leak of the refrigerant, the controller forcibly operates an air-sending device provided in the indoor unit.

8. The air-conditioning apparatus of claim 1, further comprising a second indoor unit having notification circuitry, wherein the controller controls the notification circuitry of the second indoor unit to make the first mode notification or the second mode notification, whichever is different from the notification being made by the indoor unit.

9. The air-conditioning apparatus of claim 1, further comprising:

a management device comprising circuitry configured to manage an operation state of the air-conditioning apparatus; and a communication unit comprising circuitry connected to the management device, wherein when the refrigerant detector detects the leak of the refrigerant, the controller controls the communication unit to notify the management device of occurrence of the leak of the refrigerant.

* * * * *